United States Patent [19]

Spektor et al.

[11] Patent Number: 4,508,391

[45] Date of Patent: Apr. 2, 1985

[54] MINING MACHINE FOR EXTRACTION OF MINERALS

[75] Inventors: Jury N. Spektor; Valery M. Gaponov; Felix Z. Masovich, all of Moscow, U.S.S.R.

[73] Assignee: Gosudarstvenny Proektno-Konstruktorsky I Experimentalny Institut Ugolnogo Mashinostroenia, Moscow, U.S.S.R.

[21] Appl. No.: 435,315

[22] Filed: Oct. 19, 1982

[51] Int. Cl.[3] ..... E21C 27/24

[52] U.S. Cl. ..... 299/43

[58] Field of Search ..... 299/54, 53, 43, 42, 299/18

[56] References Cited

U.S. PATENT DOCUMENTS 3,233,859 2/1966 Beoletto ..... 248/285
3,314,722 8/1967 Webster ..... 299/43

FOREIGN PATENT DOCUMENTS 2649599 5/1977 Fed. Rep. of Germany .
1521006 8/1978 United Kingdom .

*Primary Examiner*—William F. Pate, III
*Attorney, Agent, or Firm*—Fleit, Jacobson, Cohn & Price

[57] ABSTRACT

A mining machine comprises a body, drum-type cutting heads, a gantry coupled with the body, adjustable hydraulic supports disposed inside the body, grippers hinge-connected to the body by means of levers located in parallel to one another and adapted to permit moving the machine in a vertical direction, and links, each coupled with the respective top lever and with the respective hydraulic support.

1 Claim, 3 Drawing Figures

10
9

16
12
11
7
14
8
1
15
13
4
5
6

MINING MACHINE FOR EXTRACTION OF MINERALS

FIELD OF THE INVENTION

The present invention relates to mineral mining equipment, and more particularly, to mining machines for extraction of minerals.

The invention can most advantageously be used for extraction of minerals, and, primarily, thin-bedded minerals, preferably coal and salt.

BACKGROUND OF THE INVENTION

It is known to those skilled in the art that mining machines serving for exploitation of thin-bed seams may not come out of certain size limits, that is, must be relatively small in height and length because of confined operating space.

There is known a mining machine for extraction of minerals deposited in thin seams. Said machine comprises two drum-type cutting heads arranged on opposite ends of a body coupled with a gantry disposed above a conveyor. The body accommodates adjustable hydraulic supports and two grippers installed on conveyor guides and serving to hold the mining machine in position above the conveyor. Each gripper is hinge-connected to the body by means of levers positioned in parallel to one another and designed to permit vertical movement of the mining machine (cf. British Patent Specification No. 1,521,006, Class E IF, 1978, and FRG laid-open Application No. 2649599.8, 1977).

In the mining machine of the foregoing design, the body is hinge-connected to the grippers through two parallel levers, and the mining machine body position in the horizontal plane depends on location of the common axis of the hinge joints disposed beside the grippers.

The mining machine body and the gripper in set with the parallel levers form a parallel-crank mechanism serving to permit movement of the body in parallel thereof in the vertical direction when the hydraulic supports are extended or retracted.

However, gaps in the parallel-crank mechanism hinge joints may cause displacement of the body from the position parallel to the seam floor, with the result that the mining machine cutting head winning the mineral may leave wedge-shaped seam remains near the seam roof and floor.

SUMMARY OF THE INVENTION

It is an object of the present invention to provide a rigid play-free linkage comprising the body, levers and grippers and serving for parallel movement of the body in adjustment of the height thereof, and for preventing displacement thereof in relation to the grippers.

Another object of the invention is to improve the efficiency of the mining machine.

This is accomplished in a mining machine for extraction of minerals, comprising drum-type cutting heads disposed on opposite ends of a body coupled with a gantry installed above a conveyor, adjustable hydraulic supports arranged inside the body, and two grippers holding the mining machine above the conveyor, each gripper being hinge-connected to the body by means of levers located in parallel to one another and adapted to permit vertical displacement of the mining machine, wherein two links are provided according to the invention, each link being hinge-connected to the respective top lever and to the respective hydraulic support.

BRIEF DESCRIPTION OF DRAWINGS

These and other objects and advantages of the present invention will become more fully apparent from the following description of a preferred embodiment thereof taken in conjunction with the accompanying drawings, wherein.

DETAILED DESCRIPTION OF THE INVENTION

Figure 1:
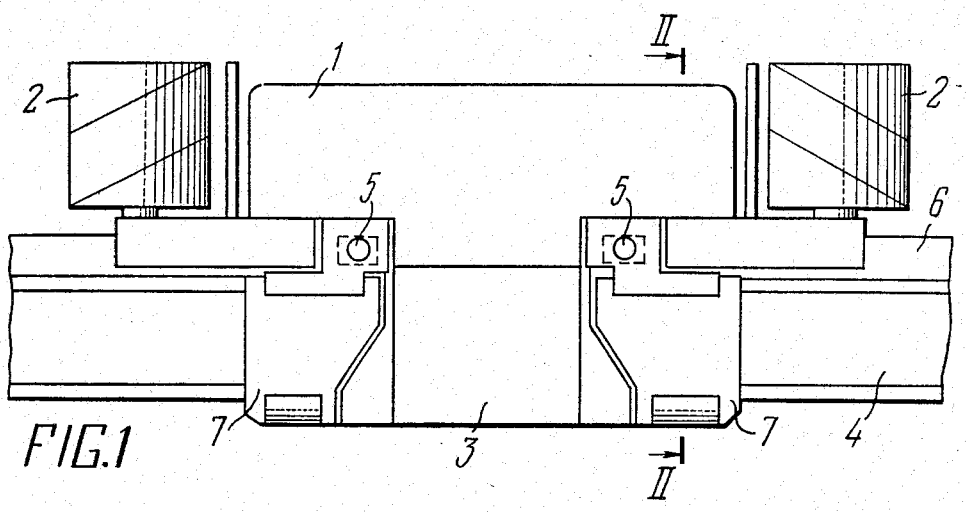
FIG. 1 is a general view of a mining machine for extraction of minerals, according to the invention.

Referring to FIG. 1, the mining machine for extraction of minerals comprises a body 1, drum-type cutting heads 2 arranged on opposite ends of the machine and serving to win the seam of minerals, and a gantry 3 whereto the body 1 is coupled. The gantry 3 is arranged above a face conveyor 4.

Figure 2:
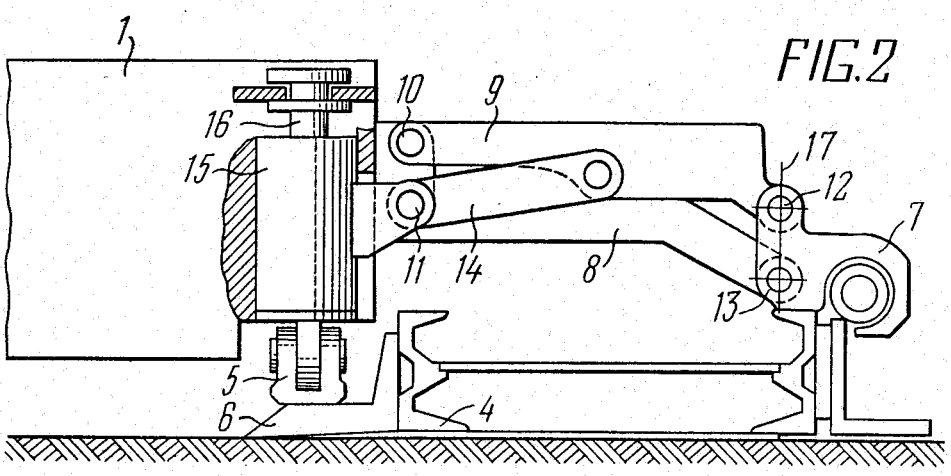
FIG. 2 is a section view of the mining machine taken along line II—II, with levers set to a full bottom position.

The body 1 accommodates hydraulic supports 5 (FIGS. 2 and 3) installed on a gatherer 6 located on the face side of the conveyor 4. Besides, the mining machine is retained in place above the conveyor 4 by means of two grippers 7 coupled with the body 1 by two pairs of levers 8 and 9. The levers 8 and 9 are linked with the body 1 by means of hinge joints 10 and 11, and are coupled with the grippers 7 by means of hinge joints 12 and 13. The levers 8 and 9 are arranged in pairs in parallel to one another.

The top lever 9, according to the invention, is connected by a link 14 to a fixed member of the support 5, for example, in the form of a cylinder 15. This feature provides for locking the mining machine in place during adjustment of the height thereof above the conveyor.

Figure 3:
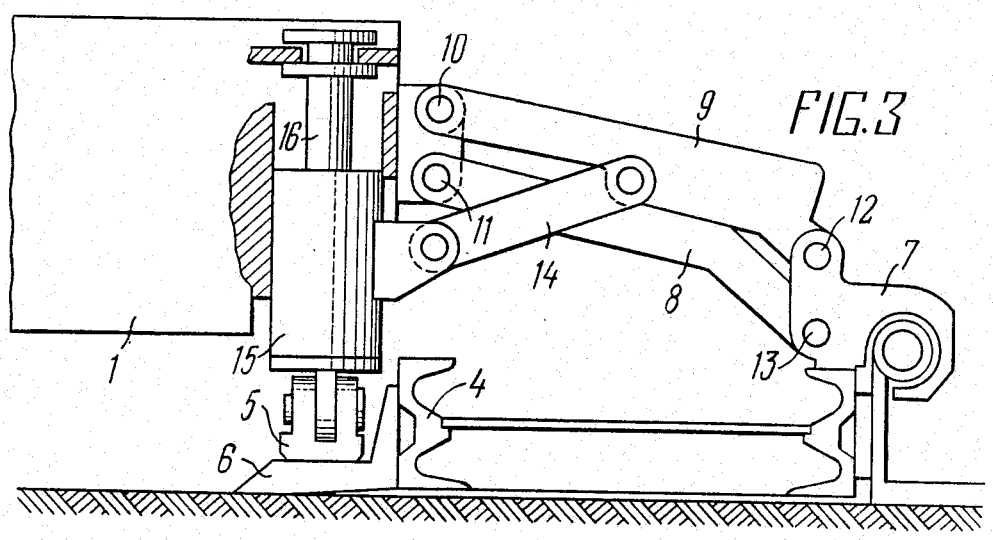
FIG. 3 is a section view of the mining machine taken along line II—II, with the levers set to a full top position.

The foregoing height adjustment of the mining machine above the conveyor 4 is effected by extending the hydraulic supports 5 (FIG. 3). The link 14 prevents folding of a parallel-crank mechanism formed by the levers 8 and 9, the body 1 and the gripper 7 since a rigid delta linkage is formed by hydraulic jacks 16 of the support 5, link 14 and the lever 9.

The link 14 is arranged in such a way that a common axis 17 of the hinge joints 12 and 13 is retained in a vertical position and no gaps occur in the hinge joints 10 to 13 of the parallel-crank mechanism that may cause tilting of the mining machine toward the face if no link 14 is provided.

Thus, the use of the link hinged with one lever and fixed member of the support permits locking the mining machine body in the horizontal plane, and provides for parallel movement of the body during height adjustment, and prevents displacements of the mining machine in the horizontal plane.

What is claimed is:

1. A mining machine for extraction of minerals from a face wherein a conveyor is installed, said machine comprising:

a body defining a first end and a second end;

a first and a second drum-type cutting head, each head mounted on one of said first and second ends of said body, respectively, said first and second drum-type cutting heads adapted for winning a seam of minerals and set to rotary motion;

a gantry mounted on said body above said conveyor;

two supports slidably mounted in said body for mounting the mining machine on the conveyor, each support having an adjustable hydraulic jack, each jack attached at one end to said body and slidably mounted in said support;

two grippers for coupling the mining machine to said conveyor and to retain said mining machine in place above the conveyor;

a first and a second set of levers, each set connecting one of said grippers to said body, and each set comprising two levers parallel to each other and positioned in such a way that one lever is located above the other lever, with both levers adapted to move the mining machine vertically in relation to said conveyor;

hinge joints, each hinge joint positioned for coupling said levers to said grippers and for coupling said levers to said body; and a first link and a second link, one end of each link being rigidly connected to a different respectvie top lever and the other end of each link being rigidly connected to a different respective support to form a rigid linkage, including said body, levers and grippers, for locking the body of the mining machine in a vertical position, parallel to an original position, upon adjustment of said hydraulic jacks.

* * * * *